United States Patent [19]

Geyer

[11] Patent Number: 5,076,456

[45] Date of Patent: Dec. 31, 1991

[54] CONTAINMENT SUMP WITH STACKABLE EXTENSIONS

[75] Inventor: Wayne B. Geyer, Northbrook, Ill.

[73] Assignee: Steel Tank Institute, Inc., Lake Zurich, Ill.

[21] Appl. No.: 482,083

[22] Filed: Feb. 20, 1990

[51] Int. Cl.[5] ..... B65D 6/00

[52] U.S. Cl. ..... 220/4.26; 220/355; 220/634

[58] Field of Search ..... 220/307, 354, 355, 4.26, 220/634

[56] References Cited

U.S. PATENT DOCUMENTS

| | | | |
|---|---|---|---|
| 537,182 | 4/1895 | Brown | 220/4.26 X |
| 3,485,408 | 12/1969 | Benesch | 220/4.26 |
| 4,573,604 | 3/1986 | Guim | 220/634 X |
| 4,960,149 | 10/1990 | Rizzitiello | 220/4.26 X |
| 4,978,023 | 12/1990 | Behlmann et al. | 220/4.26 X |

*Primary Examiner*—Stephen Marcus
*Assistant Examiner*—Nova Stucker
*Attorney, Agent, or Firm*—Rockey and Rifkin

[57] ABSTRACT

An improved containment sump assembly which provides an enclosure for pipes and other tank appurtenances associated with an underground storage tank. The containment sump assembly comprises a generally cylindrical main body section closed at its lowermost end forming a hollow interior for enclosing the pipes and equipment, a generally cylindrical top section having the same diameter as the main body section along its lower portion and tapered to provide an opening of a smaller diameter at its uppermost point. A lid for closing the top opening is also included. The main body section is further provided with a tongue component around its uppermost edge; the top section is provided with a complimentary groove component around its lowermost edge. The tongue and groove components of the respective sections are capable of mating engagement to form a liquid-tight seal when the top section is placed on the main body section. Extension members are also provided, with groove components along their lowermost edges and tongue components along their uppermost edges for installation between the main body section and top section.

2 Claims, 1 Drawing Sheet

CONTAINMENT SUMP WITH STACKABLE EXTENSIONS

BACKGROUND OF THE INVENTION

The present invention relates generally to a containment sump assembly which includes an underground chamber and cover arrangement suitable for enclosing a fill pipe and other tank appurtenances for an underground storage tank and, more particularly, to a containment sump assembly which includes stackable extensions to allow for flexibility in the installation and maintenance of the sump assembly and storage tank.

It is common practice to store flammable or toxic liquids such as gasoline, kerosene, diesel fuel or toxic chemicals in under underground storage tanks. Such tanks usually have an assortment of pipes, such as a fill pipe, vent pipe or product pipe, as well as vapor recovery equipment, pump housing and product level gauge equipment, extending from the underground storage tank upward and usually terminating anywhere from six to eighteen inches below grade level. It is common to provide a containment enclosure for such equipment to protect against ground water and seepage of water from above.

In addition to protection from water seepage, such enclosures are necessary to protect the environment against pollution due to spillage when the underground storage tanks are filled with gasoline, kerosene, diesel fuel or toxic chemicals. Regardless of the type of connection employed during filling operations, spillage occurs either because of poor connections or as a result of over-filling the tanks. Such accidental spillage must be contained to prevent pollution of the ground or water systems within the general vicinity of the storage tanks.

It is further desirable to have a containment assembly which can allow for flexibility in the placement of the sump assembly and underground storage tanks. This is accomplished by providing "stackable" extension members for a standard size containment sump assembly. Such extension members which are designed to "fit" into the containment sump assembly, and into other extension members, provide a means for adjusting the height of the containment sump assembly, during installation of the assembly. Thus, if the underground storage tank is buried at a depth different from that called for by installation specifications, resulting in the height dimensions of the sump assembly being too large or too small, the "stackable" extension members can be used to adjust the height dimensions of the sump assembly and place the entire system at the specified depth in the ground.

A variety of containment sump or manhole assemblies with adjustment or expansion means exist for underground storage tanks or sewage systems. Examples of such devices can be seen in U.S. Pat. Nos. 4,593,714; 4,706,718; 4,302,126; 4,197,031; 4,834,574; 4,469,115; 4,759,656; 4,187,647; 4,690,584; 4,273,467; 3,611,889; 1,639,495; 1,408,982; and 1,165,044. These devices are not entirely satisfactory. Some assemblies are expensive to manufacture and difficult to install; others require threaded screw mechanisms, or clamping mechanisms, resulting in expansion of sections as they are added on or a decrease in the internal diameter of the assembly opening; still others involve the use of certain types of gaskets or sealants which are often exposed to the elements, resulting in degradation of the sealing means and leakage into or out of the assembly. The containment sump assembly with stackable extension members of the present invention provides an improved design which overcomes the problems set forth above.

SUMMARY OF THE INVENTION

The present invention is directed to an improved containment sump assembly for use in providing a leak-proof passageway between underground storage tanks and ground level, and a containment means for fill pipes and other equipment associated with underground storage tanks. More particularly, the present invention is directed to a containment sump assembly having "stackable" extension members which allow for variations in the burial depths of underground storage tanks when the tanks are installed by providing the ability to adjust the height dimension of the containment sump assembly.

The containment sump assembly of the present invention provides an enclosure for the fill pipe and other pipes or equipment connections situated above the underground storage tank, and includes a structure having a main body section, a top section which holds the cover and a bottom section connected to the underground tank. The main body section is a generally hollow structure, like a manhole, of sufficient size, particularly in its diameter and height, to enclose the pipes and equipment connections and to allow sufficient room for maintenance work to be done on the pipes and equipment. The top section fits on the upper rim of the main body section, and decreases upwardly in diameter to provide a smaller circular opening into which the cover can be placed. The bottom section is flat and circular while providing an area through which connections to the underground tank can be made.

The main body section of the containment sump is molded to provide an upper edge having a rim around the outside edge, a rim around the inside edge and a circular ridge extending upwardly between the inner and outer rims. The lower edge of the top section of the sump assembly is likewise machined to provide a circular groove or recess for receiving the circular ridge of the main body section and mating the inner and outer rims of the main body section with complimentary portions of the top section. The top section of the sump assembly is also provided with a gasket extending around the recessed area to provide a liquid-tight connection between the top section and main body section of the sump assembly. This connection between the top section and main body section is called a "tongue and groove" seal.

The bottom section of the containment sump assembly is molded to the main body section; neither the bottom nor the sides of the sump assembly have any preformed penetrations, allowing the specifier/owner to dictate the size, quantity and locations of the penetrations. Piping penetrations through the walls of the sump assembly are made liquid-tight using rubber grommets, pipe sleeves in conjunction with rubber boots, or the like. Penetrations through the bottom portion can be made liquid-tight using bolted flanges, compression fittings or compression rings.

An important feature of the containment sump assembly of the present invention includes the "stackable" extension member or members which allow for adjustments in the height of the sump assembly. If, upon installation of the underground tank, the height dimensions of the sump assembly must be adjusted to compensate for variations from the system specifications, the extension members can be used to adjust the height of the sump assembly and bring the height of the entire installation within the required specifications.

Like the top section and main body section of the sump assembly, each extension is generally circular and hollow; however, the extension members do not have top and bottom closures. Instead, the extension members are provided with "tongue and groove" configurations which match up with the tongue and groove configurations on the top section and main body section of the sump assembly. In general, each extension member has a groove in its lower edge and a tongue around its upper edge which mate with the tongue and groove configurations of the top section, main body section or other extension members. Each groove configuration is provided with a gasket to obtain a liquid-tight seal between each tongue and groove assembly.

It is an object of the present invention to provide an improved containment sump assembly of the type described above.

It is another object of the present invention to provide an improved containment sump assembly having a top section, a main body section and a bottom section, with the complimentary edges of the top and main body sections having a tongue and groove configuration with gasket sealing means to allow for liquid-tight connections between the sections.

It is a further object of the present invention to provide a novel containment sump assembly which allows for adjustments in height or depth of the containment sump assembly through the use of stackable extension members having tongue and groove configurations compatible with each other and the tongue and groove configurations of the top and main body sections of the sump assembly.

DETAILED DESCRIPTION OF THE INVENTION

Figure 1:
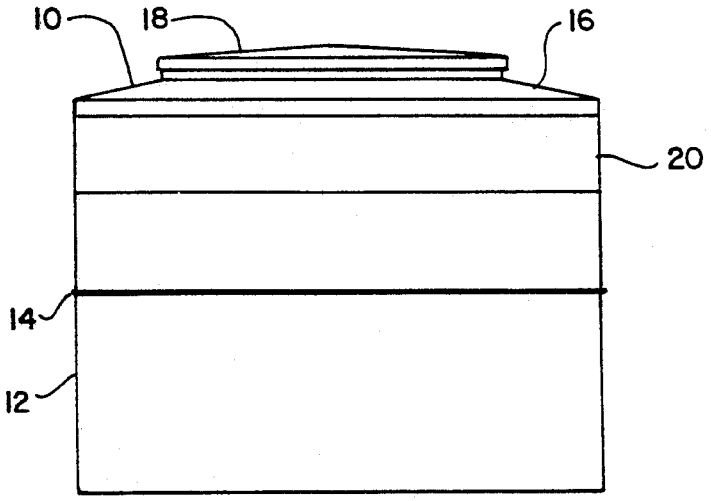
FIG. 1 is an elevational view of the containment sump assembly of the present invention.

Referring now to the drawings, there is illustrated in FIG. 1 the containment sump assembly 10 of the present invention, suitable for installation as an enclosure for piping generally associated with underground storage tanks. As illustrated in FIG. 1, the containment sump assembly 10 includes a main body section 12, which is made of a synthetic material compatible with a wide range of petroleum products. The main body section 12 is usually made or molded from a rectangular piece of synthetic material into a generally circular cylinder having a hollow body, terminating in a solid bottom of the same material. The main body section 12 is molded to provide a sump assembly with no penetrations preformed in the bottom section or the cylinder walls, enabling the specifier/owner to determine the size, quantity and location of the piping penetrations required for the underground storage tank with which the sump assembly is associated.

The sump assembly 10 also includes a top section 16, which has a base portion of the same generally circular dimensions of the main body section 12. The top section 16 tapers inwardly from its base section to provide an opening at the top of the sump assembly of substantially smaller dimensions than the hollow body of the main body section 12. A lid 18 is provided to cover the smaller opening in the top section 16.

As further shown in FIG. 1, the sump assembly of the present invention is also provided with one or more extension members 20, which like the main body section 12, are generally cylindrical sheets. The height of the extension member 20 is substantially less than the height of the main body section 12, usually in the range between one-eighth to one-third the height of the main body section 12. The extension member 20 is designed to fit between the main body section 12 and the top section 16.

Figure 3:
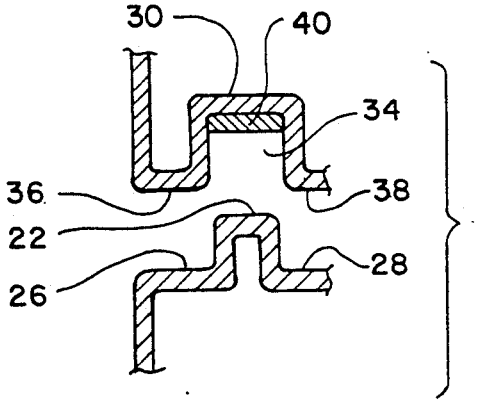
FIG. 3 is an expanded sectional view of the tongue and groove configurations of the mating edges of the top and main body sections and extension members of the containment sump assembly of the present invention.
Figure 2:
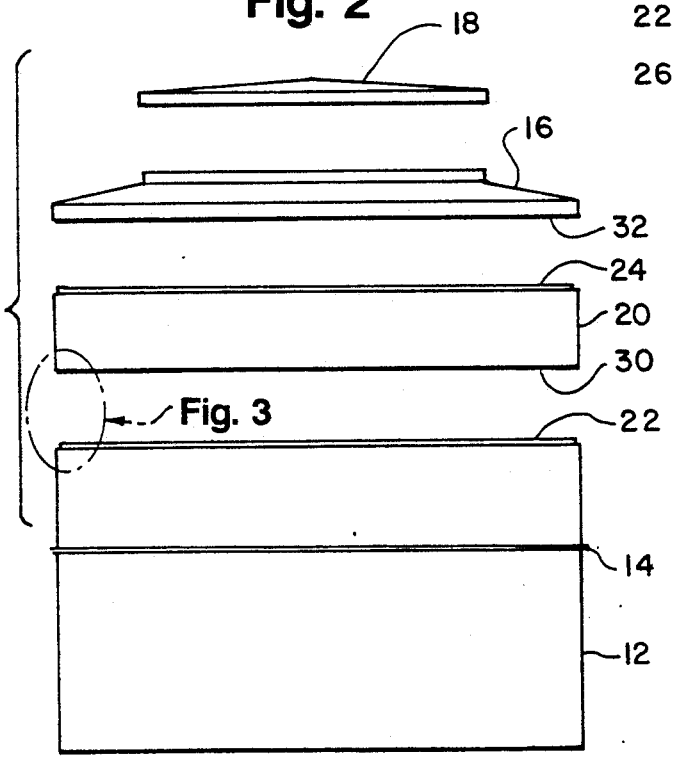
FIG. 2 is an elevational view of the containment sump assembly of the present invention with its sections, namely the top section, an extension member, main body section and bottom section illustrated as separate segments.

FIGS. 2 and 3 illustrate the manner in which the top section 16, the main body section 12 and the extension member 20 "fit" together. As shown in FIG. 2, the main body section 12 and extension member 20 are provided with ridges 22 and 24 which extend around the upper edges of the respective sections. As shown in more detail in FIG. 3, ridge 22 (and, likewise, ridge 24) is centered on the upper edge, resulting in a configuration having one flattened rim 26 on the outer surface and another flattened rim 28 on the inner surface of the upper edge of the main body section 12, with a raised ridge 22 situated therebetween. The ridge 22 extending upwardly from rims 26 and 28 is referred to herein as the "tongue" component.

As suggested in FIG. 2, and shown in detail in FIG. 3, the bottom edges 30 and 32 of the top section 16 and extension member 20, respectively, are machined to provide a generally circular recessed area 34 for receiving the complimentary ridge 22 on the main body section 12 or an extension member 20 directly below it. The recessed area 34 is centered on the bottom edge 30 (and, likewise, bottom section 32), resulting in a configuration having a flattened outer rim 36 and a flattened inner rim 38 extending downwardly from the bottom edge 30.

As can also be seen in FIG. 3, the recessed area 34 is provided with an annular gasket 40. The recessed area 34, the rims 36 and 38 extending downwardly and the gasket 40 are collectively referred to herein as the "groove" component.

When the containment sump assembly of the present invention is assembled, as shown in FIG. 1, the tongue component on the lower section, i.e., the main body section 12 or one or more extension members 20, "fits" into the groove component of the upper section, i.e., the extension member 20 or top section 16, coming into direct contact with the gasket 40, forming a sealing tongue and groove joint. Extension members 20 may be "stacked", one on top of the other, by means of the sealing tongue and groove joints, with the top section 16 being the last section installed. The mating engagement of the tongue and groove components results in a tongue and groove joint that is a liquid-tight connection and provides a sump assembly which is leak-proof in both directions—liquids from the environment do not seep into the sump assembly, and toxic liquids associated with the underground tank assembly do not seep out.

The leak-proof nature of the sump assembly of the present invention is due, at least in part, to the unique tongue and groove joints employed. When the tongue and groove components are mated, the direct contact between the gasket 40 and the upper portion of the tongue component, combined with the weight of the top section or extension members installed above, result in a liquid-tight seal between the tongue and groove components. Also, with the ridge 22 of the tongue component extending upwardly, any liquid entering the tongue and groove joint at the outer or inner rims must travel in an upwardly direction before even reaching the sealing gasket 40. Thus, the tongue and groove joint provides two barriers to the flow of liquid into or out of the sump assembly. The first is the sealing contact between the gasket and tongue component; the second is the impeding design and orientation of the ridge of the tongue component itself, causing any liquid to travel against gravity before ever reaching the sealing gasket barrier.

The liquid-tight seal provided by the tongue and groove joints is one major advantage of the containment sump of the present invention; other advantages also exist. Since no liquid or other permanent sealing means are employed, installation of the sump assembly is relatively simple—no clamping means or screw threaded mechanisms are employed. Rather, the main body section 12 is installed, the required number of extension members 20 are stacked and then the top section 16 is put in place.

Also, with the design of the present invention, the top section 16 and any extension members 20 are easily removed. If, at any time after installation of the main body section 12, or after installation of the initial assembly, the height of the assembly does not conform with the required specifications, the top section 16 and, if necessary, extension members 20 can be removed, new stackable extension members meeting the requirements installed and the top section replaced, bringing the sump assembly up to specification. Thus, if the underground storage tank is installed at a depth different from original specifications, adjustments for such variations or changes can be made by removing or adding extension members of sufficient height to orientate the sump assembly at the proper burial depth to meet the specifications for the entire assembly.

The removable nature of the top section 16 is an important advantage for other reasons as well. After the sump assembly is initially installed, various pipes and other equipment, such as product pipe, vent pipe, fill pipe, pump housing, vapor recovery and product level gauge equipment, can be assembled and installed within the assembly. To assemble and install such pipe and equipment, the largest possible access to the main body section of the body assembly is required. The top opening of the assembly is much smaller in diameter than the main body section of the sump assembly and access is limited. Thus, the ability to remove the top section 16 provides the maximum access to the main body section for assembly, installation and maintenance of pipes and other equipment.

Another advantage to the sump assembly of the present invention is the absence of any preformed penetrations in the bottom section or walls of the main body section. The sump assembly is made from any lightweight plastic material which is moldable and also compatible with the liquid or chemicals to be stored. Since the sump assembly of the present invention is most often used in conjunction with underground storage tanks for petroleum products, polyethylene is the preferred plastic material. This material is especially suitable for rotational molding, the preferred method of manufacture, and results in a sump assembly having a seamless construction between the main body section and bottom section.

The seamless construction of the sump assembly allows the specifier/owner to determine the size, quantity and location of piping, equipment or access penetrations. After piping penetrations through the walls of the main body section are made, such penetrations can be made liquid-tight through the use of rubber grommets or pipe sleeves in conjunction with rubber boots between the pipes and the penetration openings. Various types of penetrations can be made through the bottom section, and include openings for fittings, pipes or manways. The fitting can be a bolted flange, compression fitting or compression ring; the manway usually includes a bolted flange of sufficient diameter to enable entry into the tank. In usual practice, the assembly includes an arrangement of a pipe which is connected to a fitting placed on top of a manway cover located within the sump on the bottom section. As can be appreciated by those involved in the installation of such assemblies, the absence of preformed penetrations or seams in the sump assembly of the present invention provides the end user with a great degree of flexibility.

The sump assembly of the present invention is also molded with a structured support ring 14, as shown in FIG. 1, around the outside of the main body section 12. The sump and ring are made from the same material and molded at the same time; the ring is thus an integral part of the sump assembly. The ring provides support to the structure of the assembly as well as a handle for manually lifting and carrying the sump assembly to the installation site.

Finally, the lid 18 of the sump assembly, as shown in FIG. 1, is designed to fit inside the standard thirty (30) inch diameter cast iron access port which is a standard opening in the concrete cover pad usually installed above the sump assembly and underground tank system. The lid is designed to minimize infiltration of water and is generally equipped with one or more small openings to allow for access to fill pipes or recovery pipes. The lid can also be removed through the access port for inspection and maintenance of the piping components and other equipment inside the sump assembly.

The present invention has been described with respect to certain embodiments, which are not meant to and should not be construed to limit the invention. Those skilled in the art will understand that variations from the embodiments described herein may be made without departing from the invention as claimed in the appended claims.

What is claimed is:

1. A containment sump assembly for enclosing pipes and other equipment associated with an underground storage tank comprising:

(a) a generally cylindrical main body section closed at the lower end thereof providing a hollow interior for enclosing pipes and equipment plumbed therethrough, (b) a generally cylindrical top section having the same diameter as the main body section along its lower portion and tapering to provide an opening of a smaller diameter at its uppermost point, (c) at least one generally cylindrical extension member for installation between said main body section and said top section, and (d) a lid providing a closure means for the uppermost opening;

(e) said main body section being further provided with a tongue component around its uppermost edge, said top section being provided with a complimentary groove component around its lowermost edge, and said extension member having a groove component around its lowermost edge and a tongue component around its uppermost edge capable of forming tongue and groove joints with the complimentary tongue and groove components of the main body section and the top section, respectively, said tongue and groove components of said main body section, said extension member and said top body section being capable of mating engagement to form a liquid-tight seal upon installation of the sump assembly.

2. The containment sump assembly of claim 1, wherein the groove components of the top section and the extension member include sealing gaskets positioned within the uppermost section of the grooves.

* * * * *